US011721502B2

(12) United States Patent
Wang

(10) Patent No.: US 11,721,502 B2
(45) Date of Patent: Aug. 8, 2023

(54) KEYBOARD AND KEYCAP THEREOF

(71) Applicant: TAIWAN TAI-HAO ENTERPRISE CO., LTD., New Taipei (TW)

(72) Inventor: Min-Hsueh Wang, New Taipei (TW)

(73) Assignee: TAIWAN TAI-HAO ENTERPRISE CO., LTD., New Taipei (TW)

( * ) Notice: Subject to any disclaimer, the term of this patent is extended or adjusted under 35 U.S.C. 154(b) by 0 days.

(21) Appl. No.: 17/493,732

(22) Filed: Oct. 4, 2021

(65) Prior Publication Data

US 2023/0108859 A1 Apr. 6, 2023

(51) Int. Cl.
*H01H 13/705* (2006.01)
*H01H 13/83* (2006.01)

(52) U.S. Cl.
CPC ..... *H01H 13/705* (2013.01); *H01H 13/83* (2013.01)

(58) Field of Classification Search
CPC .. H01H 13/705; H01H 13/83; H01H 2219/00; H01H 2219/036; H01H 2219/014; H01H 2219/016; H01H 2219/044; H01H 2219/048; H01H 2219/054; H01H 2219/062; H01H 2219/0621; H01H 2219/064; H01H 2221/00; H01H 2221/07; H01H 2221/0702; H01H 2003/12; H01H 2009/18; H01H 2009/182; H01H 2009/183; H01H 2009/184; H01H 2009/187; H01H 2013/00; H01H 2013/50; H01H 2217/032; H01H 9/00; H01H 9/14; H01H 9/16; H01H 9/161; H01H 9/162; H01H 9/18; H01H 9/182; H01H 13/00; H01H 13/02; H01H 13/04; H01H 13/20; H01H 13/26; H01H 13/50; H01H 13/52; H01H 13/70
USPC ..... 200/5 A, 341
See application file for complete search history.

(56) References Cited

U.S. PATENT DOCUMENTS 5,278,372 A * 1/1994 Takagi ..... H01H 13/20 200/344
7,134,205 B2 * 11/2006 Bruennel ..... B29C 45/1418 29/17.2
2017/0004939 A1 * 1/2017 Kwan ..... H01H 3/125
2018/0182574 A1 * 6/2018 Wang ..... F21V 3/062

* cited by examiner

*Primary Examiner* — Anthony R Jimenez
(74) *Attorney, Agent, or Firm* — Andrew M. Calderon; Calderon Safran & Cole, P.C.

(57) ABSTRACT

A keycap is provided, including a base element, a cap and a character element. The base element includes a board main portion. The cap has a top portion, and a skirt portion. The skirt portion surrounds the top portion. The character element, located between the board main portion and the top portion. An area of the top portion corresponding to the character element is a top area. The thickness of the top area is substantially greater than or equal to 0.01 cm and substantially less than or equal to 0.3 cm.

18 Claims, 7 Drawing Sheets

KEYBOARD AND KEYCAP THEREOF

BACKGROUND

Technical Field

The disclosure relates to a keycap, especially a keycap with light-pervious character and a keyboard with the keycap.

Related Art

A keyboard generally comprises multiple keycaps and other components. Each keycap has a character on the upper surface thereof. The character may be part of the keycap, or is shown on a sticker which is pasted on the upper surface of the keycap. The character is for users to recognize which character each of the keycap represents. However, when a user uses the keyboard in the night time or in an environment where the illumination intensity is relative low, the user might not easily recognize the character on the keycap. Consequently, a keycap with light-pervious character is provided by keyboard companies.

SUMMARY

In view of this, according to an embodiment, a keycap includes a base element, a cap and a character element. The base element includes a board main portion. The cap has a top portion and a skirt portion. The character element, located between the board main portion and the top portion. An area of the top portion corresponding to the character element is a top area. A thickness of the top area is substantially greater than or equal to 0.01 cm and substantially less than or equal to 0.3 cm.

In some embodiments, the character element is set on the board main portion and protrude toward the top portion.

In some embodiments, the character element is set on the top portion and protrude toward the board main portion.

In some embodiments, the character element, corresponding to the top area, has a chamfer, and the character element includes a closed area.

In some embodiments, the character element includes a character, and the character is A, B, D, Q, O, R, 4, 6, 8, 9, or 0.

In some embodiments, the character element includes a closed area. The board main portion has at least two through holes corresponding to the closed area. One of the at least two through holes is inside of the closed areas. One of the at least two through holes is outside of the closed area. The cap further includes a least two filling portions which fills the at least two through holes.

In some embodiments, the cap further includes a film, and the film is on the top portion of the cap.

In some embodiments, the top portion of the cap has a texture structure.

In some embodiments, the cap further includes a supporting rod portion. One end of the supporting rod portion is connected to the top portion.

In some embodiments, the character element further includes a supporting rod portion. One end of the supporting rod portion is connected to the board main portion.

According to an embodiment, a keyboard includes a keyboard base and a keycap, on the keyboard base. The at least one keycap comprising a base element, a cap and a character element. The character element includes a board main portion. The cap has a top portion and a skirt portion.

The skirt portion surrounds the top portion. An area of the top portion corresponding to the character portion is a top area. A thickness of the top area is substantially greater than or equal to 0.01 cm and substantially less than or equal to 0.3 cm.

Based on the above, according to some embodiments, a keycap can be used with the keyboard shown in FIG. 1, or with other keyboards. The keycap is made by injection molding to form the cap covering top surface of character element. The top area corresponds to the character. The thickness of the top area is from 0.01 to 0.3 cm, so that users will not see the character of the character element and could clearly recognize the character when an light-emitting element below the character element emits light. In some embodiments, the character element has a closed area and the board main portion has at least two through holes respectively inside and outside of the closed area. The at least two through holes aid liquid material to flow into the inner portion of the closed area during the injection molding.

DETAILED DESCRIPTION

Figure 1:
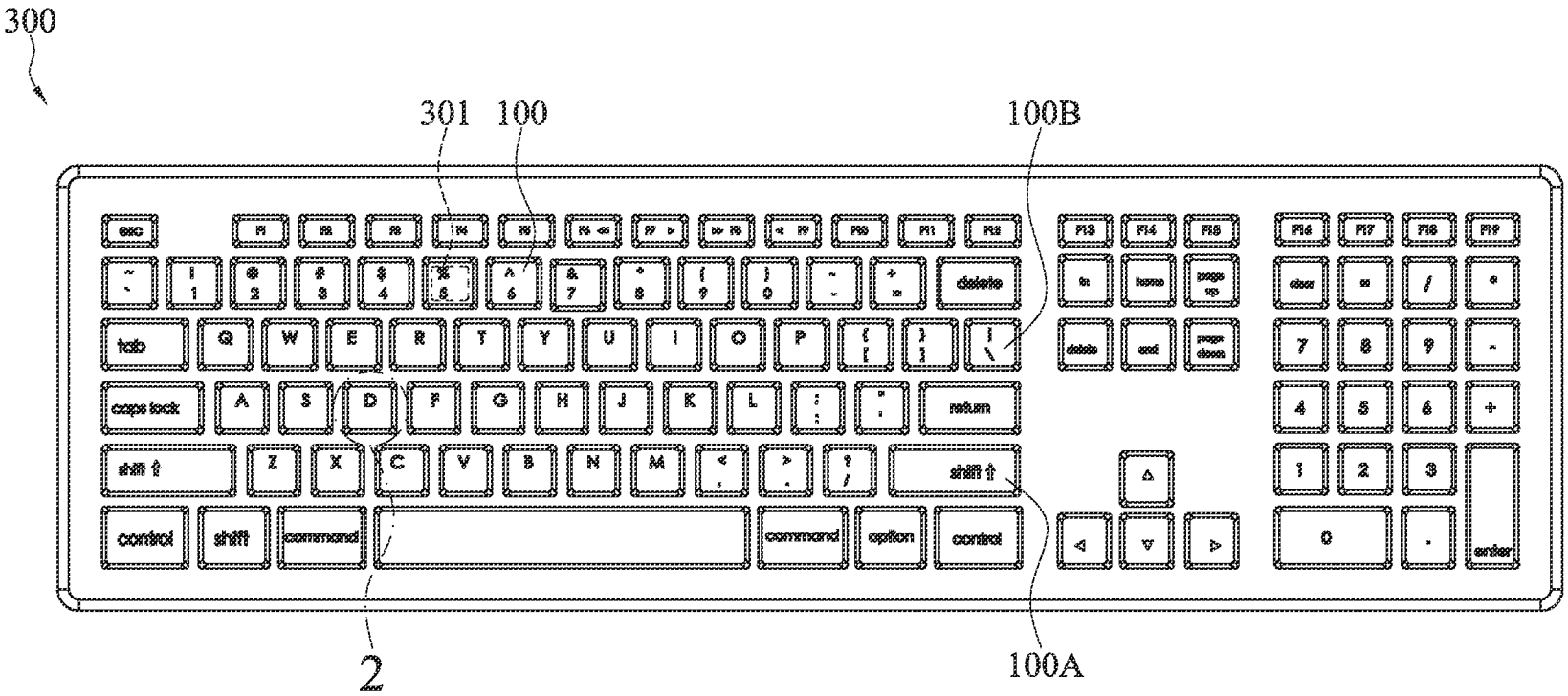
FIG. 1 illustrates a top view of a keyboard according to some embodiments.
Figure 2:
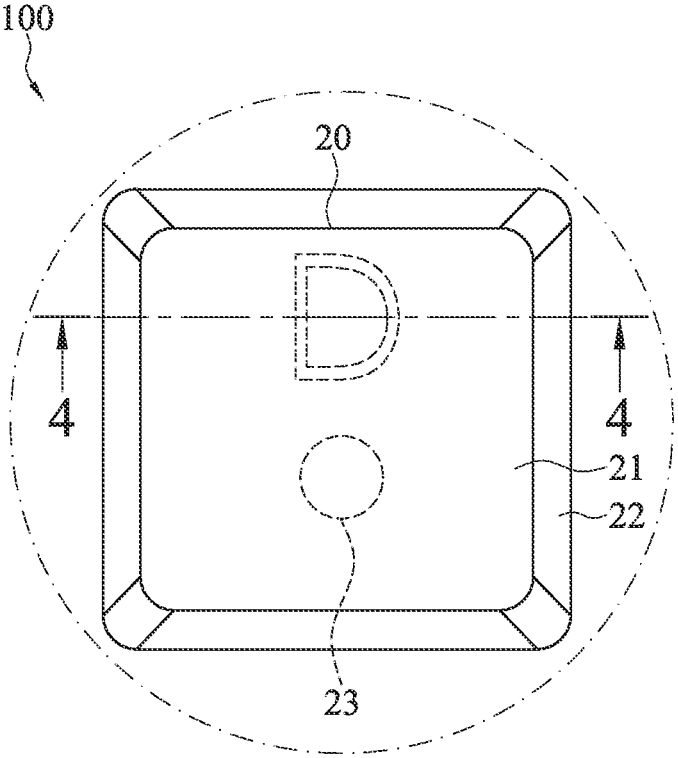
FIG. 2 illustrates a top view of a keycap according to some embodiments.
Figure 3A:
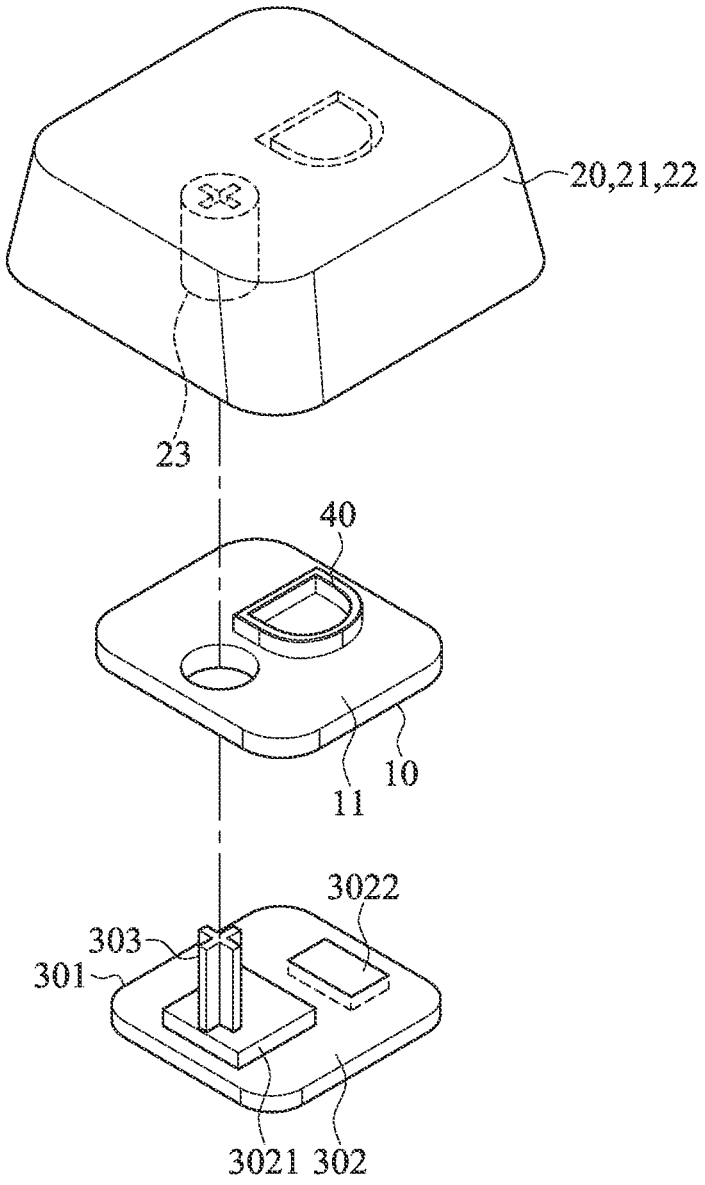
FIG. 3A illustrates a partial exploded view of a key of the keyboard of FIG. 2.
Figure 3B:
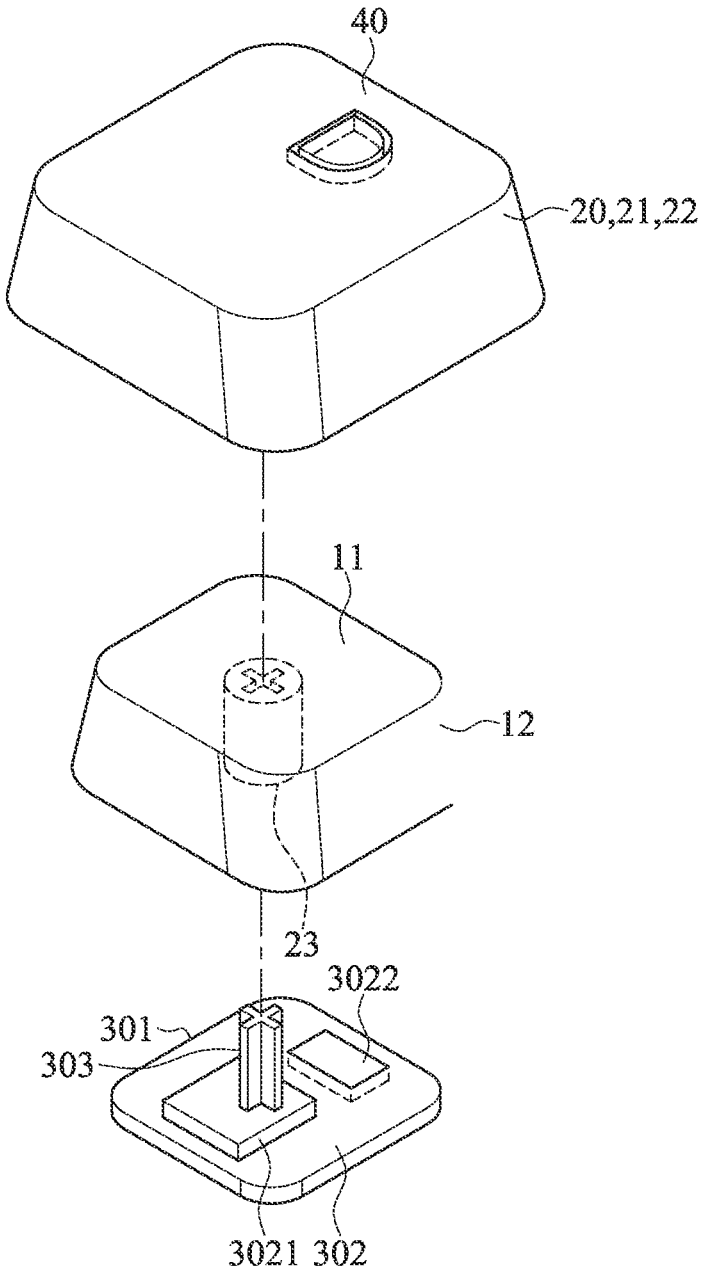
FIG. 3B illustrates a partial exploded view of a key of the keyboard of another embodiment.
Figure 4:
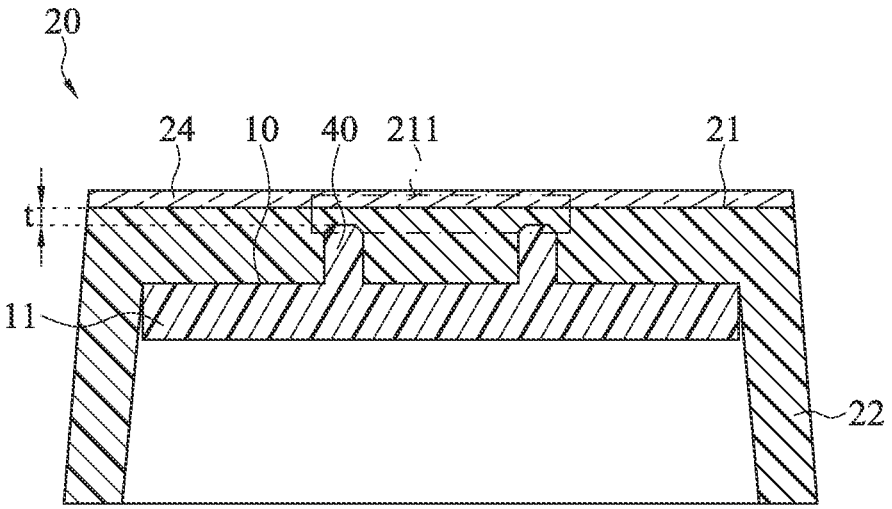
FIG. 4 illustrates a cross-sectional view of the keycap at line 4-4 of FIG. 2.

Please refer to FIGS. 1 to 4. FIG. 1 illustrates a top view of a keyboard according to some embodiments. FIG. 2 illustrates a top view of a keycap according to some embodiments. FIG. 3A illustrates a partial exploded view of a key of the keyboard of FIG. 2. FIG. 3B illustrates a partial exploded view of a key of the keyboard of another embodiment. FIG. 4 illustrates a cross-sectional view of the keycap at line 4-4 of FIG. 2. As shown in FIGS. 1, 2 and 3A, a keyboard 300 includes a keyboard base 301 and at least one keycap 100. In the embodiment of FIG. 1, the keyboard 300 includes multiple keycaps 100. Each of the keycaps 100 includes a base element 10, a cap 20 and character element 40. In some embodiments, the keyboard 300 is a light-emitting keyboard. Each of the keycaps 100 has at least a character. The character may be a letter, a word, a symbol, a special key, or a function key. The letter may be an English letter, a Chinese letter, a number, a Japanese letter, or a Spanish letter. Some keycaps 100A, 100B, like 'shift' and '\', have two characters. The character is made of a light-pervious material. In addition, light-emitting elements are on the keyboard base 301 and below the keycaps 100. When any of the light-emitting elements is activated to emit light, the light will pass the character of corresponding keycap and a user can see the character even in a dark environment. In some embodiments, the keycaps 100 can be applied to the other keyboard 300 with different specification. In some embodiments, the keycap 100 can be made of soft rubber or hard rubber.

As shown in FIGS. 2, 3A and 4, the base element 10 includes a board main portion 11. The base element 10 is made of light-pervious material. In some embodiments, the light-pervious material is, for example, transparent or translucent to visible light, and the wavelength of the visible light is about 360 nm to 780 nm.

As shown in FIGS. 2, 3A and 4, the cap 20 has a top portion 21, a skirt portion 22. The skirt portion 22 surrounds the top portion 21. The character element 40, located between the board main portion 11 and the top portion 21. In some embodiments, the character element 40 is set on the board main portion 11 and protrude toward the top portion 21, but is not limited thereto, the character element 40 also may be set on the top portion 21 and protrude toward the board main portion 10. Here, the character element 40 is provided on the base element 10 as an example. An area of the top portion 21 corresponding to the character element 40 is a top area 211. As shown in FIG. 4, a thickness t of the top area 211 is substantially greater than or equal to 0.01 cm and substantially less than or equal to 0.3 cm. The thickness t of the top area 211 is the distance between the top surface of the character element 40 and the top surface of the top portion 21.

As shown in FIG. 3A, in some embodiments, the keycap 100 further includes a supporting rod portion 23, the supporting rod portion 23 may be provided on the cap 20 or the base element 10. Here, the supporting rod portion 23 is provided on the cap 20 as an example, one end of the supporting rod portion 23 is connected to the top portion 21. In some embodiments, the keycap 100 is assembled to the keyboard base 301 through the supporting rod portion 23. Specifically, as shown in FIG. 3A, the keyboard base 301 includes a circuit board 302, a pillar 303. The circuit board 302 includes a button 3021 and a light-emitting element 3022. The pillar 303 is connected to the supporting rod portion 23. When the keycap is pressed, the supporting rod portion 23 presses the button 3021 through the pillar 303 and the corresponding light-emitting element 3022 emits light. In some embodiment, the light-emitting element 3022 is arranged on the side opposite to the pillar 303 to prevent the pillar 303 from blocking the light of the light-emitting element 3022. In some embodiments, the supporting rod portion 23 is disposed at a side opposite to the character element 40 to prevent the supporting rod portion 23 from blocking the light from the light-emitting element 3022 to the character element 40. Specifically, the supporting rod portion 23 is arranged corresponding to the pillar 303, and the character element 40 is arranged corresponding to the light-emitting element 3022. The light-emitting element 3022 is, for example, an LED, but it is not limited thereto.

In addition, as shown in FIG. 3B, the character element 40 is set on the top portion 21 and protrude toward the board main portion 10, and the supporting rod portion 23 is provided on the base element 10. In some embodiments, base element 10 further includes a skirt portion 12, the skirt portion 12 surrounds the board main portion 11. In other words, the character element 40 and the support rod 23 have various configurations. The character element 40 may be arranged on the base element 10 or the cap 20, and the support rod 23 may also be arranged on the base element 10 or the cap 20.

Figure 5:
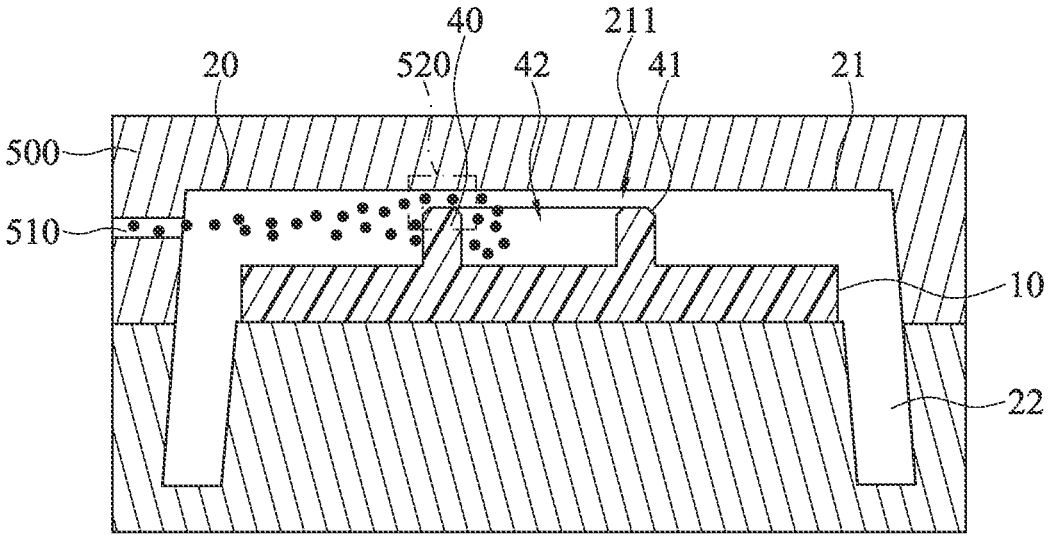
FIG. 5 illustrates a schematic diagram of the injection molding of the keycap according to some embodiments.
Figure 6A:
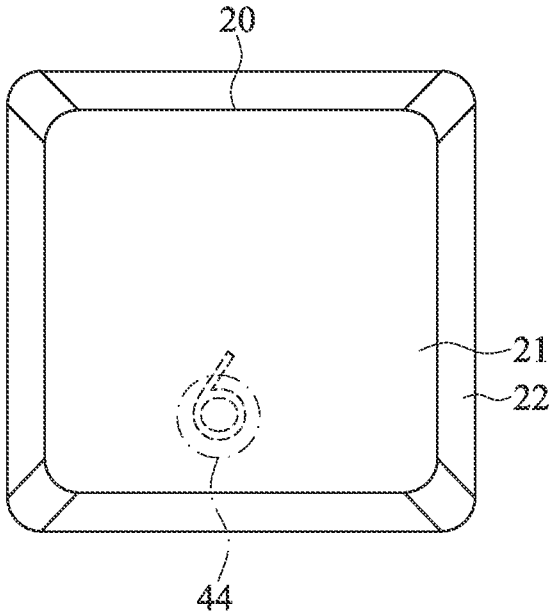
FIG. 6A illustrates a top view of a character portion including a closed area according to some embodiments.
Figure 6B:
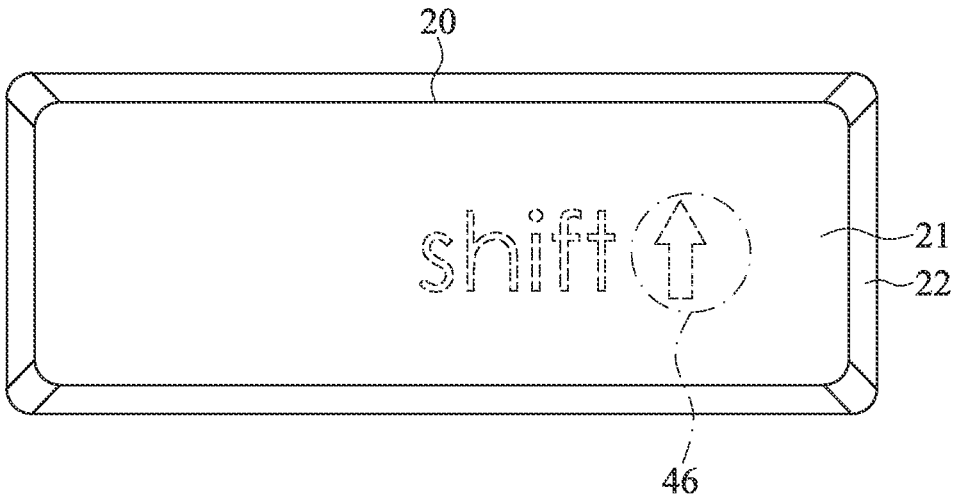
FIG. 6B illustrates a top view of another character portion including a closed area according to some embodiments.

Refer to FIG. 5. FIG. 5 illustrates a schematic diagram of the injection molding of the keycap according to some embodiments. As shown in FIG. 5, the keycap 100 is made by injection molding to form the outer shape of the cap 20 of the keycap 100. The top area 211 corresponds to the character element 40. The thickness t of the top area 211 is from 0.01 to 0.3 cm, so that users will not see the character of the character portion when the light-emitting element is not activated and could clearly recognize the character when an light-emitting element is activated to emit light. In some embodiments, the character element 40 includes a closed area 42. Please refer to FIGS. 6A and 6B. FIG. 6A illustrates a character element including a closed area according to some embodiments and FIG. 6B illustrates another character element including a closed area according to some embodiments. FIG. 6A illustrates the character element 40 is number SIX, "6." The lower part of character element 40, "6," is the closed area 44 while the upper part of the character element 40, "6," is not a closed area. Next, FIG. 6B illustrates the character element 40 is a function key, "shift" and an icon (upper arror). The icon is a closed area 46 while the word of the character element 40 includes no closed area. The character element 40 including a closed area may be A, B, D, Q, O, R, 4, 6, 8, 9 or 0. In other example, the character 9 or R, the upper half of the character is surrounded by an outline to form a ring-shaped closed area 42. Please refer to FIG. 5 again. The character element 40 of FIG. 5 is a letter "D." The outline of the character is a ring-shaped closed area 42. During the injection molding, the liquid material like liquid plastic enters the inlet 510 of the mold 500 and enters the gap 520 above the top surface of the character element 40 to fill out the closed area 42 of the character element 40. In some embodiments, the inlet 510 may be provided on other sides of the mold 500, such as the upper side, the lower side, or the right side. Here, the left side is taken as an example but not limited to this. The gap 520 above the top surface of the character element 40 corresponds to the thickness t. In some embodiments, by adjusting the pressure and flow rate of the injection molding, the material can be squeezed into the closed area 42 through the gap 520, so as to fill out the closed area 42. Therefore, the gap 520 provide a channel for the liquid material to enter and fill the closed area 42. The design could have all character element 40 maintain their original shape without creating a cut on the character having a closed area for the liquid material to pass through. In some embodiments, the character element 40, corresponding to the top area 211, has a chamfer 41. In some embodiments, the chamfers 41 of the character element 40 are respectively arranged on the outside and the inside of the character element 40 The outside of the character element 40 is a side where the material enters, and the inside of the character element 40 is a side of the closed area 42. The chamfer 41 allows the material to flow into the closed area 42 smoothly. In some embodiments, the chamfer 41 is arranged only on one side of the outside or the inside. In some embodiments, the chamfer 41 may be, for example, a beveled corner or a rounded corner. In some embodiments, the injection molding material is a liquid material.

Please refer to FIG. 4, in some embodiments, the cap 20 further includes a film 24. The film 24 is on the top portion 21 of the cap 20.

In some embodiments, the top portion 21 of the cap 20 has a texture structure. In some embodiments, the top portion 21 is covered by a texture structure, which increases the friction of the top portion 21 and enhances the touch feeling of users when the users hit or touch the keycap 100. In some embodiments, the texture structure is, for example, strip-shaped or dot-shaped.

Figure 7:
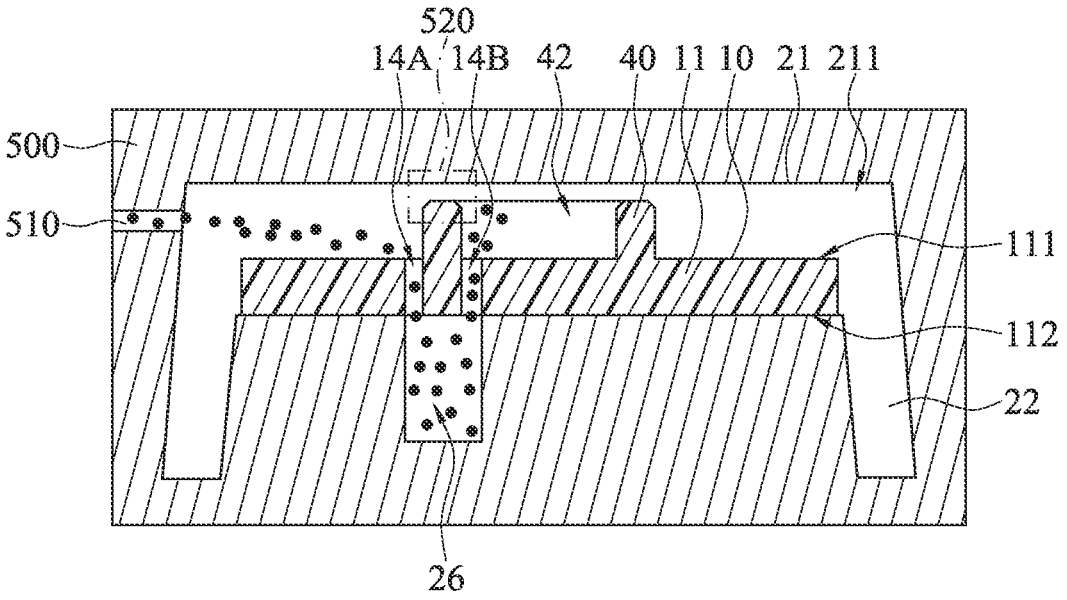
FIG. 7 illustrates a schematic diagram of the injection molding of the key cap according to some embodiments.
Figure 8:
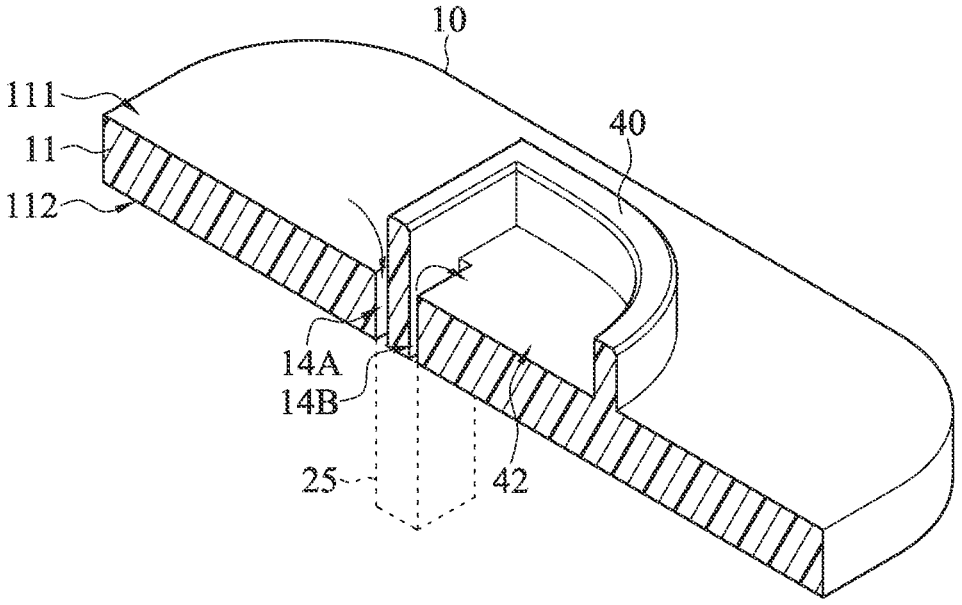
FIG. 8 illustrates a partial perspective view of a character element of FIG. 7 the keycap according to the some embodiments.

Please refer to FIGS. 7 and 8. FIG. 7 illustrates a schematic diagram of the injection molding of the keycap according to some embodiments. FIG. 8 illustrates a partial perspective view of a character element of FIG. 7 according to the some embodiments. In FIG. 7, the character element 40 includes a closed area 42. The board main portion 11 has at least two through holes 14A, 14B corresponding to the closed area 42. At least one of the at least two through holes 14B (hereinafter referred as inner through hole) is located inside of the closed areas 42, and at least one of the at least two through holes 14A, (hereinafter referred as outer through hole) is located outside of the closed area 42. The inner and outer through holes 14A, 14B provide more passages for liquid material entering the closed area 42. Specifically, during injection molding, the liquid material enters the inlet 510 of the mold 500 and enters the outer through holes 14A. The liquid material entering the outer through hole 14A then enters the cavity 26 of the mold 500 and further enters the closed area 42 through the inner through hole 14B. After the injection molding, the cap 20 includes at least two filling portions which fill the at least two through holes 14A, 14B, and a protruding post 25 (as shown in FIG. 8) which fills the cavity 26. The protruding post 25 will be removed after the injection molding.

In summary, according to some embodiments, a keycap 100 is used with the keyboard 300 shown in FIG. 1, or with other keyboards of different specifications. The keycap 100 is made by injection molding to form the cap 20 covering top surface of the character element 40 of the base element 10. The top area 211 corresponds to the character. The thickness of the top area 211 is from 0.01 to 0.3 cm, so that users will not see the character of the character element 40 and could clearly recognize the character when an light-emitting element below the character element 40 emits light. In some embodiments, the character element 40 has a closed area 42 and the board main portion 11 has at least two through holes 14A, 14B respectively inside and outside of the closed area 42. The at least two through holes 14A, 14B aid liquid material to flow into the inner portion of the closed area 42 during the injection molding.

What is claimed is:

1. A keycap, comprising:

a base element, comprising a board main portion;

a cap, comprising a top portion, and a skirt portion, wherein the skirt portion surrounds the top portion; and a character element, located between the board main portion and the top portion;

wherein an area of the top portion corresponding to the character element is a top area; and a thickness of the top area is substantially greater than or equal to 0.01 cm and substantially less than or equal to 0.3 cm; a material of the character element is a light-pervious material;

wherein the character element, corresponding to the top area, has chamfers, the chamfers are respectively arranged on an outside and an inside of the character element, and the character element includes a closed area.

2. The keycap according to claim 1, wherein the character element is set on the board main portion and protrudes toward the top portion.

3. The keycap according to claim 1, wherein the character element is set on the top portion and protrudes toward the board main portion.

4. The keycap according to claim 1, wherein the character element includes a character, and the character is A, B, D, Q, O, R, 4, 6, 8, 9, or 0.

5. The keycap according to claim 1, wherein the board main portion has at least two through holes corresponding to the closed area, one of the at least two through holes is inside of the closed area, one of the at least two through holes is outside of the closed area, the cap further includes a least two filling portions which fill the at least two through holes.

6. The keycap according to claim 1, the cap further includes a film, and the film is on the top portion of the cap.

7. The keycap according to claim 1, wherein the top portion of the cap has a texture structure.

8. The keycap according to claim 1, the cap further includes a supporting rod portion, one end of the supporting rod portion is connected to the top portion.

9. The keycap according to claim 1, the base element further includes a supporting rod portion, one end of the supporting rod portion is connected to the board main portion.

10. A keyboard, comprising:

a keyboard base; and a keycap, on the keyboard base, the keycap comprising:

a base element, and at least one character comprising a board main portion;

a cap, comprising a top portion and a skirt portion, wherein the skirt portion surrounds the top portion; and a character element, located between the board main portion and the top portion, wherein an area of the top portion corresponding to the character element is a top area; and a thickness of the top area is substantially greater than or equal to 0.01 cm and substantially less than or equal to 0.3 cm; a material of the character element is a light-pervious material;

wherein the character element, corresponding to the top area, has chamfers, the chamfers are respectively arranged on an outside and an inside of the character element, and the character element includes a closed area.

11. The keyboard according to claim 10, wherein the character element is set on the board main portion and protrudes toward the top portion.

12. The keyboard according to claim 10, wherein the character element is set on the top portion and protrudes toward the board main portion.

13. The keyboard according to claim 10, wherein the character element includes a character, and the character is A, B, D, Q, O, R, 4, 6, 8, 9, or 0.

14. The keyboard according to claim 10, wherein the board main portion has at least two through holes corresponding to the closed area, one of the at least two through holes is inside of the closed area, and one of the at least two through holes is outside of the closed area, the cap further includes a least two filling portions which fill the at least two through holes.

15. The keyboard according to claim 10, the cap further includes a film, and the film is on the top portion of the cap.

16. The keyboard according to claim 10, wherein the top portion of the cap has a texture structure.

17. The keycap according to claim 10, the cap further includes a supporting rod portion, one end of the supporting rod portion is connected to the top portion.

18. The keycap according to claim 10, the base element further includes a supporting rod portion, one end of the supporting rod portion is connected to the board main portion.

* * * * *